United States Patent [19]

Prunier

[11] 4,098,028

[45] Jul. 4, 1978

[54] ADAPTOR FOR LENS SURFACING TOOL

[75] Inventor: Louis Prunier, Oxford, Mass.

[73] Assignee: American Optical Corporation, Southbridge, Mass.

[21] Appl. No.: 789,601

[22] Filed: Apr. 21, 1977

[51] Int. Cl.[2] ..... B24B 41/06

[52] U.S. Cl. ..... 51/216 LP; 279/2 R

[58] Field of Search ..... 51/124 L, 134.5 R, 166 TS, 51/168, 105 LG, 216 T, 216 LP, 209 R, 209 DL; 269/48.1; 279/1 Q, 2 R, 123

[56] References Cited

U.S. PATENT DOCUMENTS

| | | | |
|---|---|---|---|
| 1,672,574 | 6/1928 | Maynard | 51/209 DL |
| 1,854,800 | 4/1932 | Lowenfeld | 279/1 Q |
| 2,180,550 | 11/1939 | Redinger | 51/209 R |
| 3,353,307 | 11/1967 | Sarofeen | 51/216 LP |
| 3,968,972 | 7/1976 | Morgan | 279/2 R |

*Primary Examiner*—Gary L. Smith

*Attorney, Agent, or Firm*—Jeremiah J. Duggan

[57] ABSTRACT

An expandable adaptor for interchangeable lens surfacing tools (laps). The adaptor is constructed and arranged to prevent tool loosening and/or rotational slippage during lens abrading and polishing operations. An expandable portion of the adaptor receives the customarily recessed rim of a tool and tightly grips the tool rim in collet fashion responsively to pressure exerted against the tool during a lens surfacing operation.

4 Claims, 6 Drawing Figures

ADAPTOR FOR LENS SURFACING TOOL

BACKGROUND OF THE INVENTION

1. Field of the Invention

This invention relates to ophthalmic lens surfacing apparatus with particular reference to improvements in means for adapting lens surfacing tools to lens manufacturing machinery.

2. Description of the Prior Art

Ophthalmic lenses having semi-finished surfaces requiring final precision grinding and polishing are traditionally placed against preformed tools (laps) and oscillated thereover with a force applied to the lens-tool interface, i.e. by pressing the lens against the tool.

Since the operation requires a different tool (lap) for each different lens surface shape to be produced as well as periodic replacement of worn tools, it is customary to employ tool adaptors in lens surfacing machinery. These are fastened to tool spindles or other such tool supporting mechanisms of the machinery and afford means for readily manually replacing and/or changing tools. A typical prior art adaptor is illustrated in U.S. Pat. No. 3,916,574 wherein it can be seen that the customarily recessed rim of a tool is seated upon the marginal portion of the adaptor and keyed against rotational displacement to the extent that this is possible without sacrifice of a clearance between key and key slot which is sufficient to permit ready removal and replacement of tool.

It is the requirement for and provision of this clearance between key and key slot (one in the adaptor and the other in the tool) that has heretofore led to problems of back and forth rotational slippage of tools during side to side oscillation of lenses thereover in a surfacing operation. Wear upon the adaptor and/or tool caused by rotational slippage enlarges the key-key slot clearance and compounds the problem of slippage.

In surfacing operations employing relatively slow tool rotations, the prior art continuous back and forth rotational slippage induces adaptor and/or tool wear which is promoted by inclusions of lens abrading materials. This wear necessitates uneconomical replacement of parts and if allowed to reach extremes, it adversely affects the accuracy of curvature and finish of lens surfaces being worked. In high speed operations the aforesaid rotational slippage can develop into a chatter which accelerates tool or adaptor wear and similarly adversely affects workpiece finishes.

An object of the present invention is to prevent rotational slippage between tool and adaptor during lens surfacing operations but without sacrifice of the ease and convenience of tool removal and replacement afforded by traditional clearances between interfitting components of the tool and tool adaptor.

A more specific object is to retain in the construction of a lens surfacing tool and tool adaptor combination, the usual and optimum interfitting clearances while affording automatic clamping together of tool and adapter responsively to the application of lens surfacing pressure to the tool and wherein the clamping action is automatically released with relief of the lens surfacing pressure.

Other objects and advantages of the invention will become more readily apparent from the following description.

SUMMARY OF THE INVENTION

The foregoing objects and their corollaries are accomplished by the provision of a tool adaptor of circular configuration which has its marginal portion radially slotted at a plurality of points thereabout for rendering it segmentally flexible in collet-like fashion. An upstanding annular flange disposed concentrically inwardly of the adaptor edge and through which the radial slots extend, affords outwardly expandable chucking jaws for engaging and locking a lens surfacing tool in place when surfacing pressures are applied to the tool in directions toward and against the adaptor. The adaptor is formed of a resilient material which, when relieved of the pressure tending to expand its chucking jaws, will automatically return to a relaxed condition retracting its chucking jaws and releasing the tool.

Details of the invention will become more readily apparent from the following description when taken in conjunction with the accompanying drawings.

IN THE DRAWINGS

DESCRIPTION OF THE PREFERRED EMBODIMENTS

Figure 1:
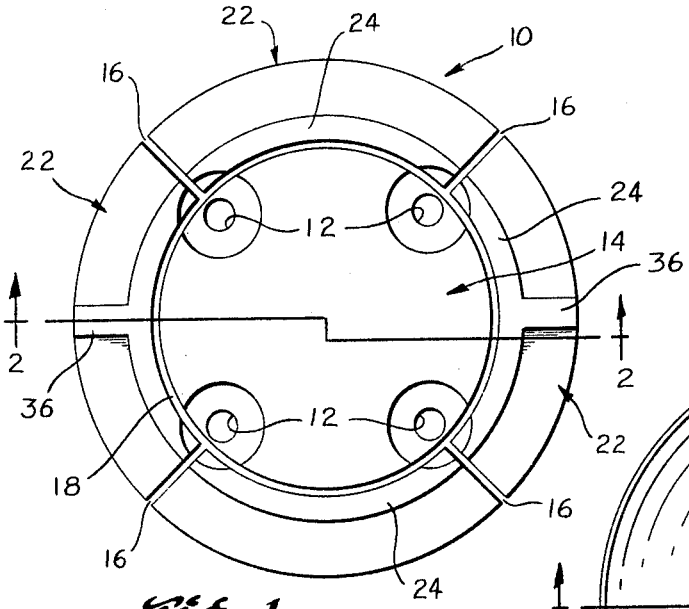
FIG. 1 is a top plan view of a preferred embodiment of the invention.

Referring more particularly to the drawings, adaptor 10 is formed of a rigid but resilient material such as for example, polyurethane or nylon which is readily flexible in thin sections. Holes 12 are provided in main central portion 14 for use in securing the adaptor to lens surfacing apparatus.

Adaptor 10 is peripherally segmented by radially inwardly directed slots 16 which extend through the full thickness of the adaptor body and communicate with a circular slot 18. Slot 18 extends only partially through the thickness of adaptor 10 leaving thin sections 20 (FIGS. 2 and 3) which form flexures for the segments 22.

Adjacent the circular slot 18 is an upstanding arcuate flange 24 on each segment 22 which provides the segment with a collet-like jaw 26.

Figure 4:
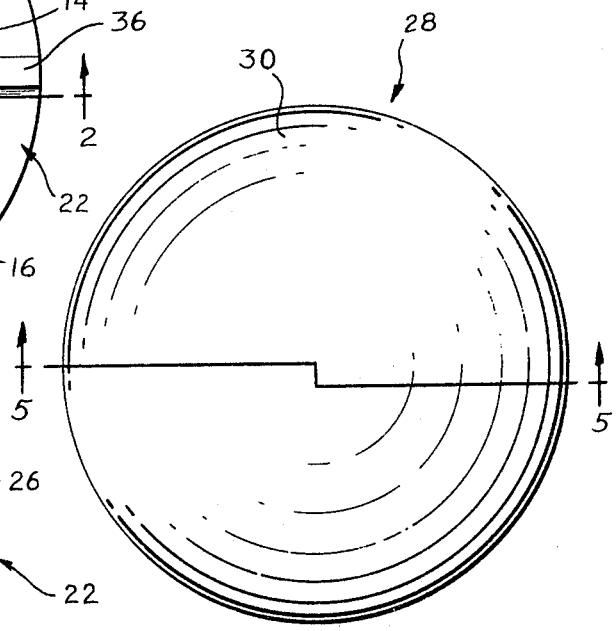
FIG. 4 is a top plan view of a lens surfacing tool.
Figure 3:
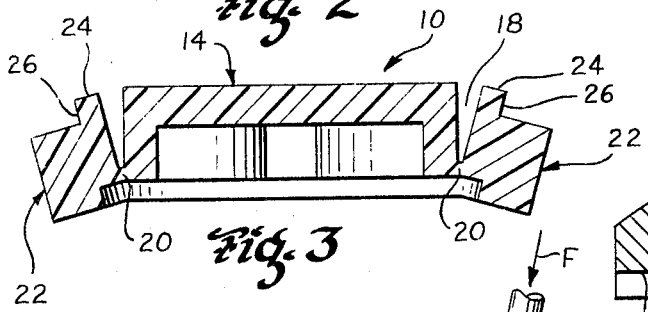
FIG. 3 is a view similar to FIG. 2 wherein a function of the adaptor is illustrated.
Figure 5:
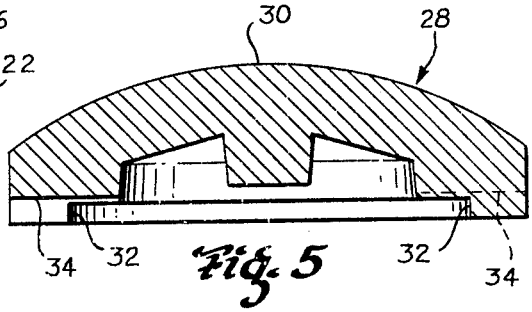
FIG. 5 is a cross-sectional view taken generally along line 5—5 of FIG. 4.
Figure 6:
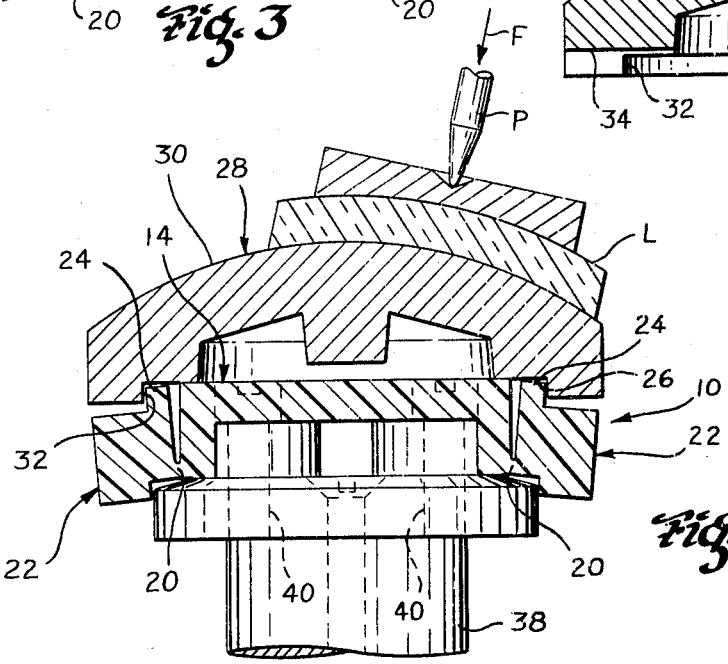
FIG. 6 is a partially cross-sectioned illustration of the adaptor of FIGS. 1–3 in a typical application of use with the tool of FIGS. 4 and 5.

With force applied against marginal portions of segments 22, flexing of the segments at their thin sections or flexures 20 may be effected as illustrated diagrammatically in FIG. 3 so as to displace jaws 26 radially away from the main central portion 14 of adaptor 10. This affords the adaptor a collet-like function for use in conjunction with a conventional lens surfacing tool (lap) as follows:

Tool 28 (FIGS. 4, 5 and 6) comprises, in customary fashion, a lens working surface 30 having a curved configuration corresponding to that desired to be produced on a lens such as lens L of FIG. 6 when the lens is oscillated over surface 30 in conventional fashion, e.g. by drive pin P. Those interested in details of a typical lens surfacing operation may refer to the aforementioned U.S. Pat. No. 3,916,574.

Oppositely of working surface 30, tool 28 is provided with the traditional depending peripheral lip 32 (FIGS. 5 and 6) having a diametrally directed slot 34 extending thereacross and which is normally fitted over diametrally disposed keys 36 (FIG. 1) of adaptor 10 as depicted in FIG. 6. As it is well known in the art and easily understood from U.S. Pat. No. 3,916,574, the present slots 34 and keys 36 locate the working surface 30 of tool 28 in a predetermined rotational orientation upon adaptor 10 according to meridinal directions of curvatures provided upon working surface 30, e.g. when working surface 30 is toroidal a meridian of one of its radii of surface curvatures is disposed in alignment with slots 34.

Referring more particularly to FIG. 6 it can be seen that adaptor 10 is secured to work spindle 38 with screws 40 extended through holes 12. With tool 28 placed upon adaptor 10, its depending lip 32 engages segments 22 marginally and fits over upstanding flanges 24 with jaws 26 thereof disposed inwardly of lip 22. Accordingly, by such means, a force F applied to pin P urges lip 32 against segments 22 of adaptor 10 forcing jaws 26 into collet-like clamping relationship with inner edge of lip 32.

By such means tool 28 is clamped against rotational slippage and/or chatter by force F applied to drive pin P.

Figure 2:
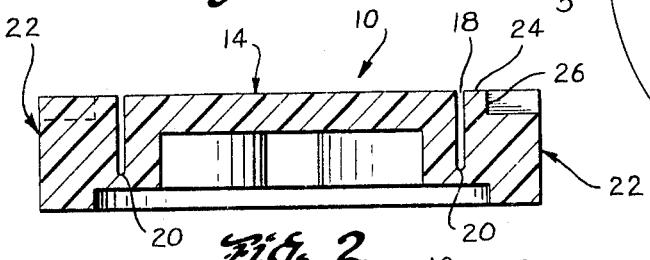
FIG. 2 is a cross-sectional view of the tool adaptor taken generally along line 2—2 of FIG. 1.

Upon release of force F and removal of a finsihed lens L from tool 28, the resiliency of adaptor 10 returns segments 22 to their normal unflexed position, e.g. that illustrated in FIG. 2, releasing tool 28 for manual removal and replacement as desired.

Those skilled in the art will readily appreciate that there are various other modifications and adaptations of the precise form of the invention here shown which may suit particular requirements. For example, adaptor 10 may be formed of metal with spring tempered flexures 20 or the thin sections of flexures 20 may be replaced with blade springs. Accordingly, the foregoing illustrations are not to be interpreted as restrictive of the invention beyond that necessitated by the following claims.

I claim:

1. An adaptor for a lens surfacing tool comprising a unitary body including a flat circular main central portion of resilient material having a first thickness and peripherally disposed circumferentially successive segment portions each flexurally connected to said central portion by a section of a thickness thinner than said first thickness, said segment portions further each having an upstanding jaw component for displacement toward and away from said main central portion for securing said tool in place upon said adaptor by flexing of said segment portions at said connections in collet-like fashion from said central portion and against a peripheral portion of said tool when said portion of said tool is forced against said segment portions.

2. A tool adaptor according to claim 1 wherein said segment portions are formed by peripherally spaced slots extending radially inwardly toward said main central portion.

3. A tool adaptor according to claim 1 wherein said upstanding jaw components are arcuate, all of substantially the same radii of curvature and disposed concentrically about a central axis through said circular adaptor.

4. A tool adaptor according to claim 1 wherein openings are provided in said main central portion of said adaptor body for use in attaching said adaptor to lens surfacing apparatus.

* * * * *